United States Patent [19]

Krabbe

[11] 4,407,098

[45] Oct. 4, 1983

[54] LIQUID STORAGE TANK WITH STEEL-REINFORCED CONCRETE EXTERIOR

[75] Inventor: Wilfried Krabbe, Dreieich-Buchschlag, Fed. Rep. of Germany

[73] Assignee: Philipp Holzman AG, Frankfurt, Fed. Rep. of Germany

[21] Appl. No.: 252,913

[22] Filed: Apr. 10, 1981

[30] Foreign Application Priority Data

Jul. 12, 1980 [DE] Fed. Rep. of Germany ..... 3026465

[51] Int. Cl.[2] ..... E04B 1/98

[52] U.S. Cl. ..... 52/167; 52/249

[58] Field of Search ..... 52/224, 167, 247, 295, 52/248, 245, 249

[56] References Cited

U.S. PATENT DOCUMENTS

| | | | |
|---|---|---|---|
| 1,078,142 | 11/1913 | Hamann | 52/295 |
| 1,305,692 | 6/1919 | Curry | 52/248 |
| 3,233,376 | 2/1966 | Naillon et al. | 52/224 |
| 4,069,642 | 1/1978 | Hendriks | 52/247 |
| 4,271,647 | 6/1981 | Balck | 52/224 |
| 4,315,385 | 2/1982 | Moreau et al. | 52/249 |

*Primary Examiner*—James L. Ridgill, Jr.

*Attorney, Agent, or Firm*—Manfred M. Warren; Robert B. Chickering; Glen R. Grunewald

[57] ABSTRACT

A reinforced concrete tank to surround a steel tank for storage of liquified natural gas which includes a base plate and an upstanding cylindrical wall with the base plate having a plurality of polygonal swing plates hinged to it to move about the hinge in a radial direction but not in a tangential direction and suporting the cylindrical wall above the base plate on projections from the wall that bear on the tops of the swing plates. The tank thus supported permits radial motion of the base plate due to thermal expansion or contraction but resists tangential forces such as those caused by earthquakes or explosions.

6 Claims, 6 Drawing Figures

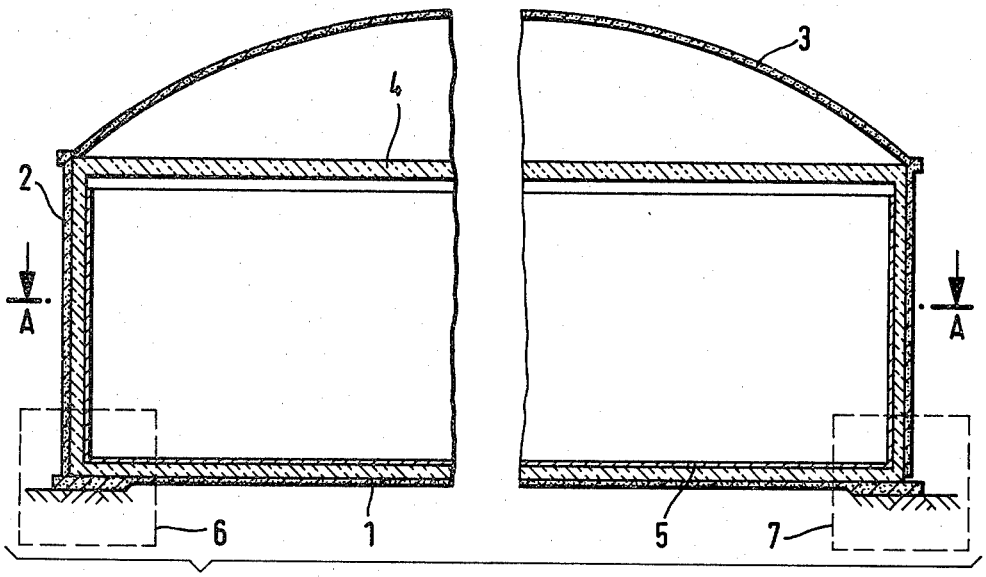
FIG. 1
FIG. 2
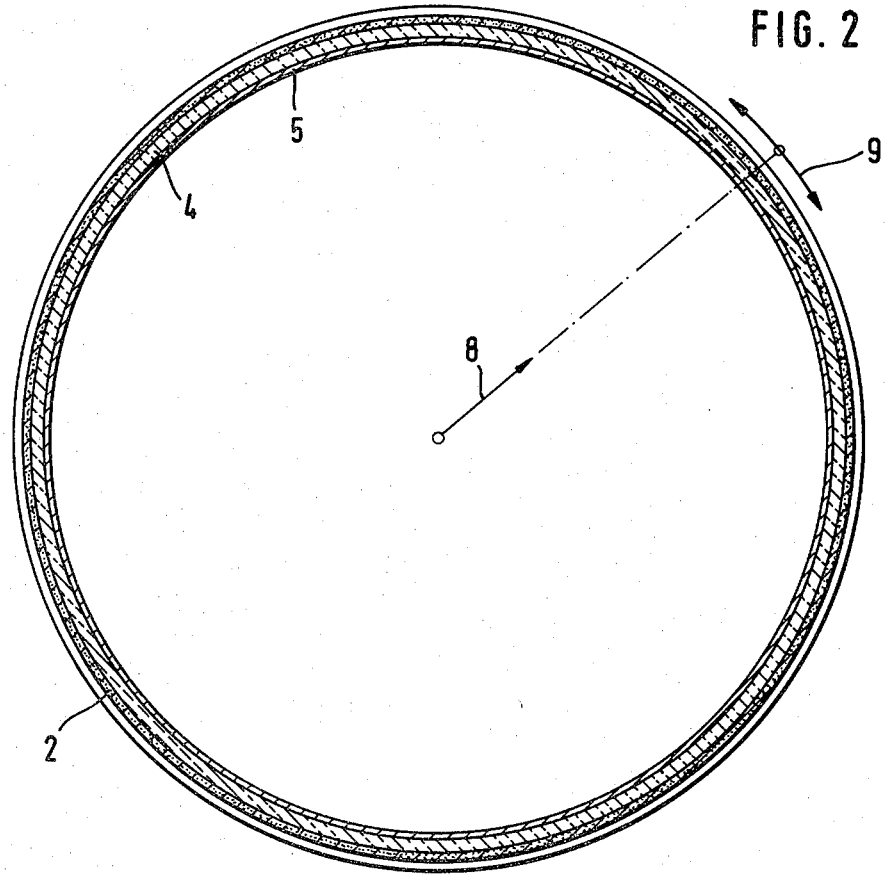

LIQUID STORAGE TANK WITH STEEL-REINFORCED CONCRETE EXTERIOR

FIELD OF THE INVENTION

The invention concerns a tank with steel-reinforced concrete exterior, for the storage of liquids, especially of super-cooled liquified gases, the wall of which shows a circular plan and is located as a separate unit on the base of the tank.

BACKGROUND OF THE INVENTION

The use of natural gas as an energy source in home and industry has won increasing importance recently. Besides transport of the gas from distant sources to consumers via pipelines, transport also is effected by sea after the gas has been liquified. The liquified gas then requires appropriate storage means when unloaded, whereby prescribed safety conditions must be met.

Thus the tank must be earthquake-proof on the one hand but must also be able to resist the strain of a gas cloud explosion.

Since such storage tanks are generally located near transportation routes, e.g. sea lanes, railway lines and highways, on which explosive substances are often transported, a gas cloud explosion in the area of the storage tank, e.g. in the event of an accident involving a vehicle loaded with fuel or the like, is always a possibility.

Storage tanks which meet these requirements consist of a steel-reinforced concrete exterior tank, in which is located a steel inner tank to hold the liquified gas, with appropriate insulation inserted between.

A familiar design provides that the structural connection between the tank wall and the base, which is necessary to transfer the horizontal load applied to the steel-reinforced concrete tank, e.g. in the case of an earthquake or a gas cloud explosion, is a monolithic rigid angle.

However, this design has the disadvantage that temperature loading conditions, particularly when they arise suddenly, as when the inside of the steel-reinforced concrete tank is dampened by liquified natural gas, can hinder deformation of the tank wall and thus lead to bending stress on the tank wall and the tank base. Such temperature loading conditions must be reckoned with, for leaks or splashing over of the contents of the inner tank, which is usually open at the top, can bring the liquified gas into contact with the steel-reinforced concrete inner wall, so that the connection between wall and base of the steel-reinforced concrete tank is greatly endangered, and this danger can lead to permanent damage.

Another steel-reinforced concrete tank design also is known, in which the tank wall is a separate unit located on the base. A construction of this type does not, however, fulfill the safety requirements in the case of a gas cloud explosion, since the tank wall could then be shifted as a whole on the base.

The object of the invention is to create a tank with steel-reinforced concrete exterior of the last-named type, which fulfills safety requirements as well as avoiding uncontrollable bending moment stresses under temperature loading conditions, independent of their intensity, which can only be roughly estimated, and thus leads to a decisive increase in the operating safety of the tank.

SUMMARY OF THE INVENTION

This object is attained in the invention by designing the bearing between tank wall and base so that it is fixed in the tangential direction of the tank wall but moveable in the radial direction to maintain deformations of the parts of the tank.

Thus the invention provides that, in spite of the separation between tank wall and base, the prevention of a tangential shift means that the tank wall as a whole cannot shift with respect to the tank base, while radial relative movements are everywhere possible, so that local radial deformations are not hindered and cannot lead to unallowable bending moment stresses.

In an advantageous embodiment of the invention, the mounting is accomplished by means of polygonal swing plates, which are positioned with their planes parallel to the tank wall and at a distance from the latter, so that one side of the polygon is located on the tank base and the opposite side or angle of the polygon is located on the outside of the tank wall.

The swing plates are preferably triangular in shape and bear at three points, of which in each case two are located on the base and the corresponding third point is located on the tank wall.

The polygonal design of the swing plates and the location of one side of the polygon on the base permits a radial swing motion but prevents swing motion in a tangential direction.

It is effective to design the bearing points as hinged bearings which are rigid in the tangential direction. Hinged bearings of this type are fixed bearings which do not permit a radial shift of the swing support feet but do permit a tipping motion.

In order to further reduce the possibility of movement of the tank side wall in tangential direction, it is effective to position the swing plates on the base plate at regular intervals around the circumference, to locate in the intervening spaces steel-reinforced concrete blocks connected to the base, and to provide sliding bearings between the neighboring surfaces of the swing plates and the steel-reinforced concrete blocks, which sliding bearings permit relative sliding motion between the swing plates and the steel-reinforced blocks when the swing plates move about the tipping axis of the bearings.

An additional preferred embodiment of the invention consists in locating for bearing purposes first, on the lower outside edge of the wall, steel-reinforced concrete teeth at intervals around the circumference, and second, on the base plate, steel-reinforced concrete blocks to project between the teeth while remaining a certain distance from them along the circumference; in providing sliding bearings at regular intervals around the circumference, between the bottom surface of the tank wall and the base plate; and in providing sliding bearings between the neighboring vertical surfaces of the teeth and blocks, which sliding bearings permit a radial sliding movement between the teeth and blocks while preventing a tangential movement.

DETAILED DESCRIPTION OF THE INVENTION

Figure 3:
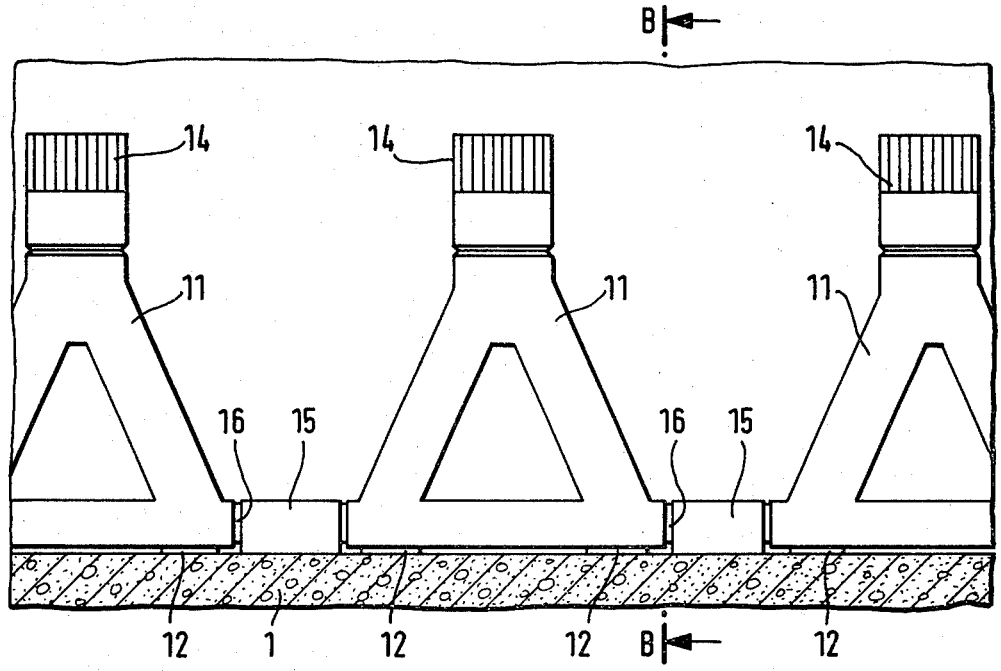

The invention is explained in more detail in the following, with reference to the examples illustrated in the drawings. In the drawings:

FIG. 1 signifies a vertical section through a tank for liquified gas to illustrate the familiar design, and the design according to the invention, of the connection between tank wall and base plate.

FIG. 2 signifies a horizontal section along the line A—A in FIG. 1.

FIG. 3 signifies an embodiment of the bearing of the tank wall on the base plate by means of swing plates, according to the invention.

Figure 4:
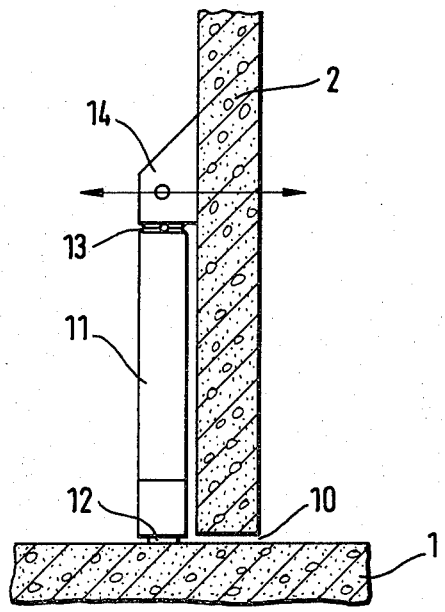

FIG. 4 signifies a section along the line B—B in FIG. 3.

Figure 5:
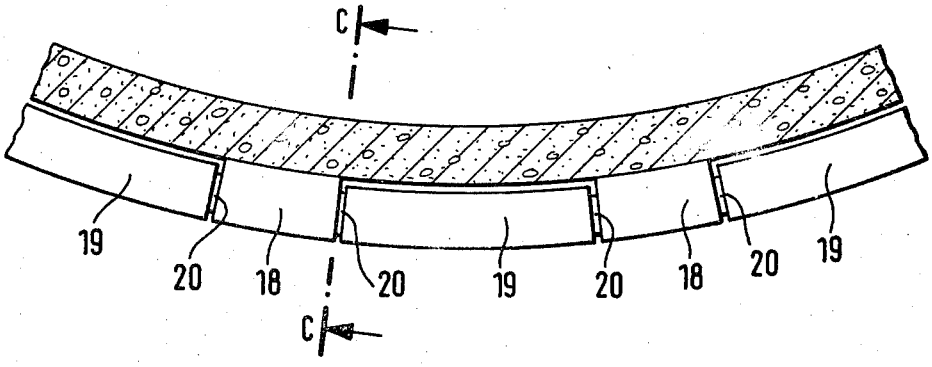

FIG. 5 signifies another embodiment of the bearing between tank wall and base plate according to the invention.

Figure 6:
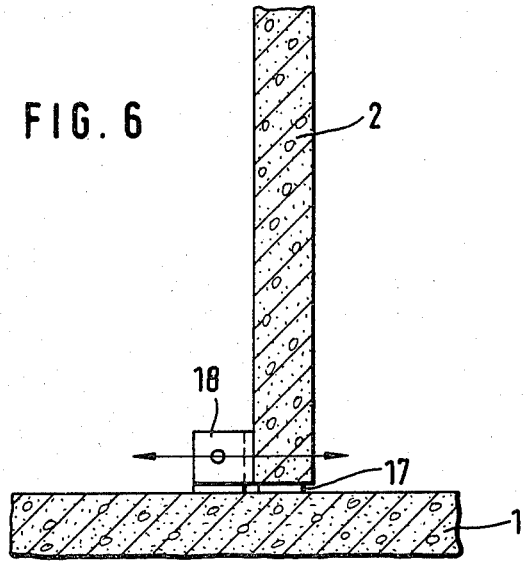

FIG. 6 signifies a section along the line C—C in FIG. 5.

FIGS. 1 and 2 show a tank with steel-reinforced concrete exterior, which consists of a base plate 1, a cylindrical tank wall 2 and a cover 3. Within the outer tank an inner tank 5 is located, separated by insulation 4, which inner tank preferably is made of steel, is open at the top and serves to hold liquified natural gas. FIG. 1 shows in the broken-line rectangle 6 the rigid, monolithic connection between the tank wall 2 and the base plate 1, which has been customary up to now, while the broken-line rectangle 7 indicates the connection between tank wall 2 and base plate 1 according to the invention, further clarified with reference to FIGS. 3 to 6, which connection is radially moveable but tangentially rigid. The arrow 8 in FIG. 2 illustrates the radial direction, in which movement between the tank wall 2 and the base plate 1 is possible, while the arrows 9 represent the tangential directions, in which movement between tank wall 2 and base plate 1 is prevented.

In the preferred embodiment of the invention represented in FIGS. 3 and 4, the tank wall 2 forms a unit separated from the base plate 1 by a joint 10, whereby the connection between the tank wall 2 and the base plate 1 is effected by means of swing plates 11. The swing plates 11 are triangular in the illustrated example, whereby their plane is parallel to the tank wall 2. The swing supports have a slight clearance from the tank wall 2 and are located at regular intervals around the tank wall. The base side of the swing plates is carried by two hinged bearings 12 each bearing on the base plate 1. Hinged bearings are fixed bearings, e.g. bearings that prevent a shift of the swing plates radially with respect to the base plate and in the plane of the swing plates, but which permit tipping of the swing plates about an axis which lies in a plane perpendicular to the plane of the paper in FIG. 3. The upper ends of the swing plates are connected by means of a hinged bearing 13 to one block 14 each, which block is attached to the outside of the tank wall 2. The swing plates as well as the blocks consist of steel-reinforced concrete, like the tank.

The described arrangement attains the object that, in the case of a horizontal load applied to the tank, e.g. from earthquakes or gas cloud explosions, a relative movement between the tank wall as a whole and the base plate is prevented, because the swing supports and their bearings receive such forces, independently of the direction from which they come. Beyond that, there is the possibility, in case of a sudden temperature loading, e.g. by escaping liquified gas, that local deformations resulting from temperature loading can occur in the radial direction, so that destructive bending moment stresses at the transition from tank wall 2 to base plate 1, affecting the steel-reinforced construction, cannot arise. The operating safety of the tank is decisively increased hereby.

In order to further increase the resistance to tangential movement of the swing plates, it is effective to locate the swing plates 11 at regular intervals and to provide steel-reinforced concrete blocks 15 in the intervening spaces, which blocks are connected to the base plate, whereby between the neighboring vertical surfaces of the swing plates 11 and the steel-reinforced concrete blocks 15 sliding bearings 16 are provided, so that the swing plates 11 are immobilized in the tangential direction but can nevertheless easily be moved in the radial direction about the hinged bearings 12.

In the embodiment of the invention represented in FIGS. 5 and 6 the swing plates may be omitted. Here, the tank wall 2 bears on the base plate 1 by means of sliding bearings 17, which are moveable in every direction, and at the lower edge of the tank wall 2 steel-reinforced concrete teeth 18 are located at regular intervals around the outside, and on the base plate 1 there are located steel-reinforced concrete blocks 19, which project into the intervening spaces between the teeth 18 and show a radial clearance from the latter, and there are once again sliding bearings 20 between the neighboring vertical surfaces of the teeth 18 and the steel-reinforced concrete blocks 19, which sliding bearings make possible radial sliding movement between the teeth and blocks while preventing any tangential movement.

What is claimed is:

1. A tank for storage of liquid, especially supercooled liquid, comprising an inner tank to hold liquid and being supported on a base plate, a reinforced concrete wall surrounding said inner tank and separately supported by said base plate, with the reinforced concrete wall supported by polygonal swing plates (11) which are located at their planes parallel to said concrete wall (2) and at a distance from it, with one side of the polygonal swing plate bearing on the base plate (1) and an opposite side or angle of the polygonal swing plate bearing against the outside of the concrete wall to support the concrete wall with its bottom above the base plate.

2. Tank with steel-reinforced concrete exterior as in claim 1, characterized by locating the swing plates (11) on the base plate (1) at intervals around the circumference, by locating in the intervening spaces steel-reinforced concrete blocks (15) connected to the base plate (1), and by providing sliding bearings (16) between the neighboring vertical surfaces of the swing plates (11) and the steel-reinforced concrete blocks (15), which sliding bearings permit a relative sliding motion between the swing plates (11) and the steel-reinforced concrete blocks (15) when the swing plates move about the tipping axis of the bearing (12, 13).

3. Tank with steel-reinforced concrete exterior as in claim 1, characterized by locating for bearing purposes first, on the lower outside edge of the tank wall (2) steel-reinforced concrete teeth (18) at intervals around the circumference, and second, on the base plate (1) steel-reinforced concrete blocks (19) to project between the teeth while remaining a certain distance from them along the circumference; by locating sliding bearings (17) around the circumference between the bottom surface of the tank wall (2) and the base plate (1); and by providing sliding bearings (20) between the neighboring side surfaces of the teeth (18) and the blocks (19), which sliding bearings permit a radial sliding motion between the teeth and blocks while preventing a tangential motion.

4. Tank with steel-reinforced concrete exterior as in claim 1, characterized by having the swing plates (11) bear at three points, of which in each case two are located on the base plate (1) and the corresponding third bearing point is located on the tank wall (2).

5. Tank with steel-reinforced concrete exterior as in claim 4, characterized by designing the bearing points as hinged bearings or pivot bearings (12, 13) that are rigid in a tangential direction.

6. A tank useful for storing cold liquids comprising an external reinforced concrete shell having a vertical wall with a circular cross section in plan view, a base plate, polygonal swing plates hinged to said base plate to be moveable about said hinge only in a radial direction, projections from said wall bearing on the upper portion of said swing plates, whereby said vertical wall is supported above the base plate by the upper portion of the swing plate, said swing plate is supported on said base plate at said hinge whereby said vertical wall is moveable with respect to the said base plate only in a radial direction said base plate is moveable with respect to said vertical wall in a radial direction but not in a tangential direction.

* * * * *

UNITED STATES PATENT AND TRADEMARK OFFICE

CERTIFICATE OF CORRECTION

PATENT NO. : 4,407,098

DATED : October 4, 1983

INVENTOR(S) : WINFRIED KRABBE

It is certified that error appears in the above-identified patent and that said Letters Patent are hereby corrected as shown below:

Column 4, line 36, delete "at" in first occurrence, and insert ---with---.

Signed and Sealed this

*Thirteenth* Day of *December 198*

[SEAL]

*Attest:*

GERALD J. MOSSINGHOFF

*Attesting Officer*

*Commissioner of Patents and Trademarks*